US010706788B2

(12) United States Patent
Chen et al.

(10) Patent No.: US 10,706,788 B2
(45) Date of Patent: Jul. 7, 2020

(54) COMPENSATION METHOD AND COMPENSATION APPARATUS FOR OLED PIXEL AND DISPLAY APPARATUS

(71) Applicant: BOE TECHNOLOGY GROUP CO., LTD., Beijing (CN)

(72) Inventors: Yi Chen, Beijing (CN); Min He, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 274 days.

(21) Appl. No.: 15/746,858

(22) PCT Filed: Aug. 9, 2017

(86) PCT No.: PCT/CN2017/096532

§ 371 (c)(1),
(2) Date: Jan. 23, 2018

(87) PCT Pub. No.: WO2018/153032

PCT Pub. Date: Aug. 30, 2018

(65) Prior Publication Data

US 2020/0082767 A1 Mar. 12, 2020

(30) Foreign Application Priority Data

Feb. 23, 2017 (CN) ..... 2017 1 0100112

(51) Int. Cl.
*G09G 3/00* (2006.01)
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2320/0204* (2013.01)

(58) Field of Classification Search
CPC .. G09G 3/3208; G09G 3/3225; G09G 3/3233; G09G 3/3291; G09G 3/3648;
(Continued)

(56) References Cited

U.S. PATENT DOCUMENTS 5,315,230 A * 5/1994 Cordoba ..... G05F 3/245 323/313
6,078,060 A * 6/2000 Shibuya ..... G02F 1/13454 257/66

(Continued)

FOREIGN PATENT DOCUMENTS

CN 103562988 A 2/2014
CN 104637440 A 5/2015

(Continued)

OTHER PUBLICATIONS

Search Report and Written Opinion for International Application No. PCT/CN2017/096532 dated Nov. 23, 2017.

(Continued)

*Primary Examiner* — Michael J Eurice
(74) *Attorney, Agent, or Firm* — Calfee, Halter & Griswold LLP

(57) ABSTRACT

The present disclosure relates to a compensation method and a compensation apparatus for an OLED pixel and a display apparatus, which relates to the field of display technology. The compensation method for an OLED pixel includes: acquiring a threshold voltage of a driving transistor; acquiring a mobility of the driving transistor according to the threshold voltage of the driving transistor; and compensating the OLED pixel according to the mobility of the driving transistor.

14 Claims, 2 Drawing Sheets

(58) Field of Classification Search
CPC ... G09G 2300/0417; G09G 2300/0439; G09G 2300/0819; G09G 2300/0842; G09G 2300/0876; G09G 2320/0233; G09G 2320/043; G09G 2320/045; G09G 2230/00
See application file for complete search history.

(56) References Cited

U.S. PATENT DOCUMENTS 9,262,965 B2 2/2016 Nam et al.
9,373,281 B2 6/2016 Wu et al.
9,378,678 B1 * 6/2016 Lee ..... G09G 3/2003
9,424,782 B2 8/2016 Park et al.
9,460,661 B2 10/2016 Shim et al.
2006/0149493 A1 * 7/2006 Sambandan ..... G09G 3/3233 702/118
2007/0115225 A1 * 5/2007 Uchino ..... G09G 3/3233 345/76
2007/0200804 A1 * 8/2007 Kwon ..... G09G 3/2014 345/76
2007/0268217 A1 * 11/2007 Ahn ..... G09G 3/325 345/76
2008/0048949 A1 * 2/2008 Kim ..... G09G 3/3233 345/80
2008/0074413 A1 3/2008 Ogura
2009/0179838 A1 * 7/2009 Yamashita ..... G09G 3/3233 345/84
2009/0219235 A1 * 9/2009 Yamamoto ..... G09G 3/3233 345/80
2011/0012819 A1 * 1/2011 Ryu ..... G09G 3/3233 345/82
2011/0084955 A1 * 4/2011 Kim ..... G09G 3/3283 345/212
2011/0090208 A1 * 4/2011 Long ..... G09G 3/3233 345/211
2011/0109299 A1 * 5/2011 Chaji ..... G09G 3/3283 324/76.11
2011/0205250 A1 * 8/2011 Yoo ..... G09G 3/3233 345/690
2011/0298836 A1 * 12/2011 Komiya ..... G09G 3/3233 345/690
2012/0162177 A1 * 6/2012 Lee ..... G09G 3/3258 345/211
2012/0293482 A1 * 11/2012 Wu ..... G09G 3/3233 345/212
2014/0084932 A1 * 3/2014 Chaji ..... G09G 3/3233 324/414
2014/0132642 A1 * 5/2014 Wu ..... G09G 3/3233 345/690
2014/0139510 A1 * 5/2014 Han ..... G09G 3/3233 345/212
2014/0152633 A1 * 6/2014 Park ..... G09G 3/3291 345/207
2014/0159609 A1 * 6/2014 Xie ..... H01L 27/3265 315/228
2014/0285407 A1 * 9/2014 Chaji ..... G09G 3/3233 345/76
2014/0340432 A1 * 11/2014 Chaji ..... G09G 3/3258 345/690
2015/0084843 A1 * 3/2015 Li ..... G09G 3/3258 345/76
2015/0123953 A1 5/2015 Shim et al.
2015/0154908 A1 6/2015 Nam et al.
2015/0187276 A1 * 7/2015 Shim ..... G09G 3/3233 345/77
2015/0325174 A1 * 11/2015 Yu ..... G09G 3/3233 345/77
2015/0339974 A1 * 11/2015 Wu ..... G09G 3/3233 345/690
2015/0379940 A1 * 12/2015 Kishi ..... G09G 3/3225 345/690
2016/0005356 A1 * 1/2016 Zhang ..... G09G 3/3233 345/690
2016/0035276 A1 * 2/2016 Yin ..... G09G 3/3233 345/78
2016/0041676 A1 * 2/2016 Tan ..... G06F 3/0416 345/173
2016/0042690 A1 * 2/2016 Chang ..... G09G 3/3258 345/212
2016/0086544 A1 * 3/2016 Park ..... G09G 3/3233 345/690
2016/0111042 A1 * 4/2016 Pyeon ..... G09G 3/3208 345/212
2016/0111044 A1 * 4/2016 Kishi ..... G09G 3/3233 345/690
2016/0155377 A1 * 6/2016 Kishi ..... G09G 3/3233 345/214
2016/0189614 A1 * 6/2016 Tani ..... G09G 3/3258 345/211
2016/0189627 A1 6/2016 Park et al.
2016/0232840 A1 * 8/2016 Tseng ..... G09G 3/3225
2016/0300534 A1 * 10/2016 Kishi ..... G09G 3/3233
2016/0351096 A1 * 12/2016 Tani ..... G09G 3/3233
2016/0379553 A1 * 12/2016 Cho ..... G09G 3/3233 345/76
2017/0194604 A1 * 7/2017 Chun ..... H01L 27/3248
2017/0221418 A1 * 8/2017 Xiang ..... G09G 3/3233
2017/0243539 A1 * 8/2017 Li ..... G09G 3/3233
2017/0249899 A1 * 8/2017 Xiang ..... G09G 3/3233
2017/0287403 A1 * 10/2017 Xiang ..... G09G 3/3258
2018/0174517 A1 * 6/2018 Lee ..... G09G 3/3233
2018/0357959 A1 * 12/2018 Xiang ..... G09G 3/3233

FOREIGN PATENT DOCUMENTS

CN 104700772 A 6/2015
CN 105096820 A 11/2015
CN 105761677 A 7/2016
CN 106023892 A 10/2016
CN 106782333 A 5/2017
EP 2881932 A2 6/2015
KR 101577907 B1 12/2015

OTHER PUBLICATIONS

First Office Action for Indian Patent Application No. 201827004333 dated Mar. 23, 2020.

* cited by examiner

COMPENSATION METHOD AND COMPENSATION APPARATUS FOR OLED PIXEL AND DISPLAY APPARATUS

CROSS REFERENCE

The present application is based upon International Application No. PCT/CN2017/096532, filed on Aug. 9, 2017, which is based upon and claims priority to Chinese Patent Application No. 201710100112.8, filed on Feb. 23, 2017, and the entire contents thereof are incorporated herein by reference.

TECHNICAL FIELD

The present disclosure relates to the field of display technology, and more particularly, to a compensation method and a compensation apparatus for an OLED pixel and a display apparatus.

BACKGROUND

An Organic Light Emitting Diode (OLED), as a current type light emitting device, has been widely used in high performance display field due to its advantages of self-luminous, fast response, wide viewing angle and being formable on a flexible substrate. According to a driving mode, the OLED may be classified into a passive matrix driving OLED (PMOLED) and an active matrix driving OLED (AMOLED). The AMOLED display is expected to become a next generation of flat panel display to replace an LCD (Liquid Crystal Display) due to its low manufacturing cost, high response speed, low power consumption, DC driving available for portable devices and wide operating temperature range.

In an existing OLED pixel, a driving transistor is usually made of semiconductor material such as amorphous silicon, polysilicon or metal oxide. However, limited by the manufacturing process, electrical parameters such as the threshold voltage Vth and the mobility K and the like of each driving transistor DT of the OLED pixel frequently fluctuate, thus causing that a current flowing through the OLED device changes with fluctuation of the threshold voltage Vth and the mobility K of the driving transistor DT, resulting in uneven luminance and affecting the display image quality.

It should be noted that, information disclosed in the above background portion is provided only for better understanding of the background of the present disclosure, and thus it may contain information that does not form the prior art known by those ordinary skilled in the art.

SUMMARY

An object of the present disclosure is to provide a compensation method and a compensation apparatus for an OLED pixel and a display apparatus.

Other features and advantages of the disclosure will become apparent from the following detailed description, or may be partly learned by practice of the present disclosure.

According to an aspect of the present disclosure, there is provided a compensation method for an OLED pixel, including:

acquiring a threshold voltage of a driving transistor;

acquiring a mobility of the driving transistor according to the threshold voltage of the driving transistor; and compensating the OLED pixel according to the mobility of the driving transistor.

In an exemplary embodiment of the present disclosure, the acquiring a threshold voltage of a driving transistor includes:

applying a first driving voltage to a control terminal of the driving transistor to turn on the driving transistor;

detecting a critical voltage of a first terminal of the driving transistor when an output current of the driving transistor changes from non-zero to zero; and acquiring the threshold voltage of the driving transistor according to the first driving voltage and the critical voltage.

In an exemplary embodiment of the present disclosure, the acquiring a threshold voltage of a driving transistor further includes:

setting an initial voltage of the first terminal of the driving transistor to zero while the first driving voltage is applied to the control terminal of the driving transistor.

In an exemplary embodiment of the present disclosure, the acquiring a threshold voltage of a driving transistor further includes:

increasing the voltage of the first terminal of the driving transistor through a charging capacitor before detecting the critical voltage of the first terminal of the driving transistor when the output current of the driving transistor changes from non-zero to zero.

In an exemplary embodiment of the present disclosure, the acquiring a mobility of the driving transistor according to the threshold voltage of the driving transistor includes:

applying a second driving voltage to a control terminal of the driving transistor to turn on the driving transistor;

detecting a reference voltage of a first terminal of the driving transistor; and acquiring the mobility of the driving transistor according to the reference voltage, wherein a difference value between the second driving voltage and the threshold voltage of the driving transistor is at least ten times higher than the reference voltage.

In an exemplary embodiment of the present disclosure, the acquiring a mobility of the driving transistor according to the threshold voltage of the driving transistor further includes:

setting the voltage of the first terminal of the driving transistor to zero while the second driving voltage is applied to the control terminal of the driving transistor.

In an exemplary embodiment of the present disclosure, the acquiring a mobility of the driving transistor according to the threshold voltage of the driving transistor further includes:

increasing the voltage of the first terminal of the driving transistor through a charging capacitor before detecting the reference voltage of the first terminal of the driving transistor.

In an exemplary embodiment of the present disclosure, the compensating the OLED pixel according to the mobility of the driving transistor includes:

acquiring a compensation voltage according to the difference value between the second driving voltage and the threshold voltage of the driving transistor and the mobility of the driving transistor.

In an exemplary embodiment of the present disclosure, the compensation voltage is a ratio of the difference value between the second driving voltage and the threshold voltage of the driving transistor to a square root of the mobility of the driving transistor.

In an exemplary embodiment of the present disclosure, a voltage is provided to a control terminal of the driving transistor by a data line through a first transistor, and a voltage is provided to a first terminal of the driving transistor by a detection line through a second transistor, wherein the first transistor is turned on in response to a first scan signal and the second transistor is turned on in response to a second scan signal.

according to an aspect of the present disclosure, there is provided a compensation apparatus for an OLED pixel, including:

a threshold voltage acquiring circuit, configured to acquire a threshold voltage of a driving transistor;

a mobility acquiring circuit, configured to acquire a mobility of the driving transistor according to the threshold voltage of the driving transistor; and a compensation circuit, configured to compensate the OLED pixel according to the mobility of the driving transistor.

According to an aspect of the present disclosure, there is provided a display apparatus, including the above pixel compensation apparatus.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure. Apparently, the accompanying drawings in the following description are merely some embodiments of the present disclosure, and those skilled in the art may further derive other drawings based on these accompanying drawings without creative labor.

REFERENCE NUMERALS

Figure 1:
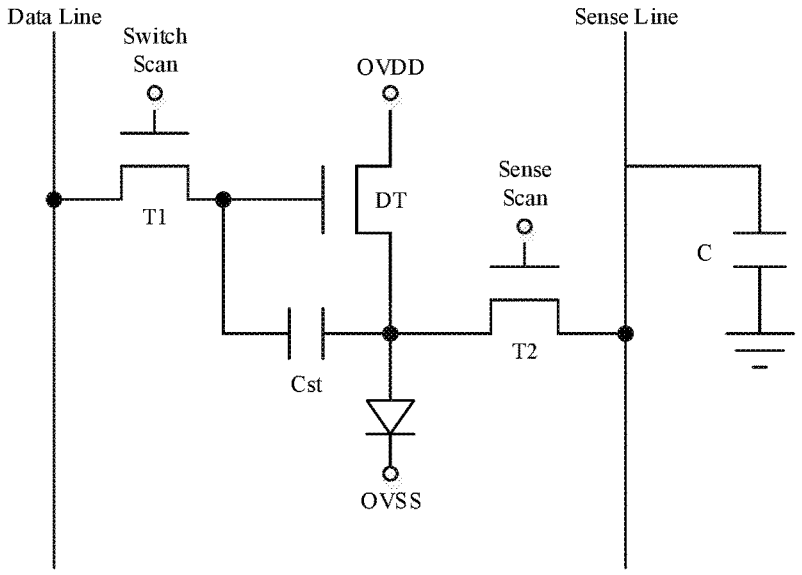
FIG. 1 schematically shows a structural schematic diagram of an OLED pixel unit in an exemplary embodiment of the present disclosure.

Data Line data line
Sense Line detection line
Switch Scan first scan signal
Sense Scan second scan signal
OVDD first voltage signal terminal
OVSS second voltage signal terminal
DT driving transistor
T1 first transistor
T2 second transistor
C charging capacitor

DETAILED DESCRIPTION

Example embodiments will now be described more fully with reference to the accompanying drawings. However, the example embodiments may be embodied in many forms and should not be construed as limited to the examples set forth herein; rather, these embodiments are provided to make the present disclosure more thorough and complete, and to fully convey the concepts of the example embodiments to those skilled in the art. The features, structures, or characteristics described herein may be combined in one or more embodiments in any suitable manner.

In addition, the drawings are merely schematic representations of the present disclosure and are not necessarily drawn to scale. The same reference numerals in the drawings denote the same or similar parts, and repetitive description thereof will be omitted. Some of the block diagrams shown in the drawings are functional entities and do not necessarily correspond to physically or logically separate entities. These functional entities may be implemented in a software form or implemented in one or more hardware modules or integrated circuits or implemented in different networks and/or processor devices and/or microcontroller devices.

The present exemplary embodiment provides a compensation method for an OLED pixel, for compensating a threshold voltage Vth and a mobility K of a driving transistor DT. FIG. 1 is a schematic structural diagram of an OLED pixel unit corresponding to the pixel compensation method. The OLED pixel unit includes: a driving transistor DT and an OLED device (i.e., an organic light emitting diode) connected to the driving transistor DT. A control terminal of the driving transistor DT is connected to a data line Data Line through a first transistor T1, a first terminal of the driving transistor DT is connected to a first voltage signal terminal OVDD, and a second terminal of the driving transistor DT is connected to a detection line Sense Line through a second transistor T2. The detection line Sense Line is further grounded via a charging capacitor C. The other terminal of the OLED device is connected to a second voltage signal terminal OVSS. In the embodiment, a control terminal of the first transistor T1 receives the first scan signal Switch Scan and a control terminal of the second transistor T2 receives the second scan signal Sense Scan.

Figure 2:
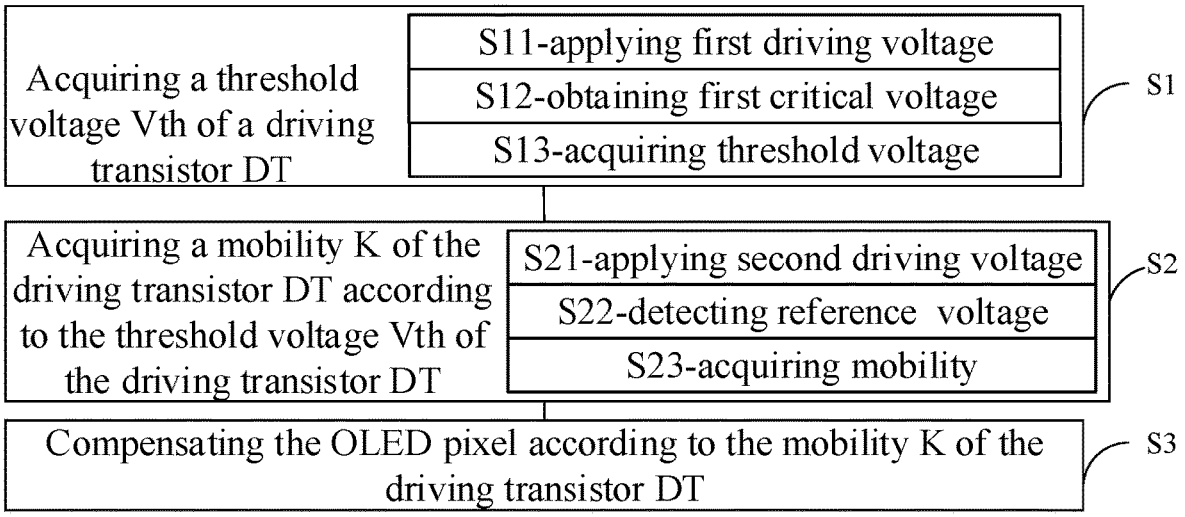
FIG. 2 schematically shows a flowchart of a compensation method for an OLED pixel in an exemplary embodiment of the present disclosure.

Based on this, as shown in FIG. 2, the compensation method for an OLED pixel may include:

S1, acquiring a threshold voltage Vth of a driving transistor DT;

S2, acquiring a mobility K of the driving transistor DT according to the threshold voltage Vth of the driving transistor DT; and S3, compensating the OLED pixel according to the mobility K of the driving transistor DT.

In the OLED pixel compensation method provided by the exemplary embodiment of the present disclosure, the threshold voltage Vth and the mobility K of the driving transistor DT are acquired and both of them are compensated when a driving voltage is set, to offset the influence of the threshold voltage Vth and the mobility K of the driving transistor DT on its output current Iout. In this way, the output current Iout of the driving transistor DT of each pixel unit tends to be consistent, so as to ensure uniformity of the display luminance and improve the display image quality.

It should be noted that, the driving transistor DT in the present exemplary embodiment may be an enhancement type transistor or a depletion type transistor, which is not specifically limited herein.

The OLED pixel compensation method in this exemplary embodiment will be described in detail below.

In step S1, a threshold voltage Vth of a driving transistor DT is acquired.

In this example embodiment, the threshold voltage Vth of the driving transistor DT may be acquired through following steps.

S11, a first driving voltage V1 is applied to a control terminal of the driving transistor DT to turn on the driving transistor DT, and an initial voltage of the first terminal of the driving transistor DT is set to zero.

In the embodiment, the first driving voltage V1 may be provided by the data line Data Line through the first transistor T1, and in this case, the first transistor T1 should be turned on under control of the first scan signal Switch Scan. An initial voltage of the first terminal (i.e., the terminal connected to the second transistor T2) of the driving transistor DT may be provided by the detection line Sense Line through the second transistor T2, and in this case, the second transistor T2 should be turned on under control of the second scan signal Sense Scan. In addition, a value of the first driving voltage V1 should be subject to being capable of fully turning on the driving transistor DT. It should be noted that, the reason to set the voltage of the first terminal of the driving transistor DT to zero is to eliminate the influence of the residual voltage on a detection result.

S12, a critical voltage Vsc of the first terminal of the driving transistor DT when an output current of the driving transistor DT changes from non-zero to zero is detected.

In this example embodiment, the critical voltage Vsc of the first terminal of the driving transistor DT may be obtained by reading a voltage signal of the detection line Sense Line.

Since the detection line Sense Line is grounded through the charging capacitor C, the voltage (i.e., a charging voltage of the second transistor T2) of the first terminal of the driving transistor DT will gradually increase as the output current of the driving transistor DT charges the charging capacitor C through the second transistor T2.

According to the I-V characteristic of the driving transistor DT, it can be seen that the output current of the driving transistor DT is:

$$Iout=K\times(Vgs-Vth)^2=K\times(Vg-Vs-Vth)^2=K\times(V1-Vs-Vth)^2;$$

wherein, K is the mobility of the driving transistor DT, Vg is the voltage of the control terminal of the driving transistor DT, Vs is the voltage of the first terminal of the driving transistor DT, and Vth is the threshold voltage of the driving transistor DT.

It can be seen that, when the voltage of the first terminal of the driving transistor DT rises to V1-Vth, the driving transistor DT is pinched off, the output current is 0, and at this time, the voltage of the first terminal of the driving transistor DT no longer changes, i.e., being the critical voltage Vsc. That is to say, the time when the output current of the driving transistor DT changes from non-zero to zero is the time when the voltage of the first terminal of the driving transistor DT rises to V1-Vth, and then the critical voltage Vsc equals V1-Vth.

S13, the threshold voltage Vth of the driving transistor DT is acquired according to the first driving voltage V1 and the critical voltage Vsc.

Specifically, when the output current of the driving transistor DT is zero, the voltage of the control terminal of the driving transistor DT is V1 and the voltage of the first terminal of the driving transistor DT is the critical voltage Vsc. Based on the above output current relationship $Iout=K\times(V1-Vsc-Vth)^2=0$ of the driving transistor DT, it may obtain that the threshold voltage Vth of the driving transistor DT equals V1-Vsc.

Based on the above steps S11-S13, the threshold voltage Vth of the driving transistor DT may be obtained.

In step S2, a mobility K of the driving transistor DT is acquired according to the threshold voltage Vth of the driving transistor DT.

In this example embodiment, the mobility K of the driving transistor DT may be specifically obtained through following steps.

S21, a second driving voltage V2 is applied to a control terminal of the driving transistor DT to turn on the driving transistor DT, and at the same time a voltage of the first terminal of the driving transistor DT is set to zero.

In the embodiment, the second driving voltage V2 may be provided by the data line Data Line through the first transistor T1, and in this case, the first transistor T1 should be turned on under control of the first scan signal Switch Scan. A voltage of the first terminal of the driving transistor DT may be provided by the detection line Sense Line through the second transistor T2, and in this case, the second transistor T2 should be turned on under control of the second scan signal Sense Scan. In addition, a value of the second driving voltage V2 is preferably a voltage that may fully turn on the driving transistor DT and is sufficiently large. For details, reference may be made to requirements in the next step. It should be noted that, the reason to set the voltage of the first terminal of the driving transistor DT to zero is to eliminate the influence of the residual voltage on a detection result.

S22, a reference voltage Vr of a first terminal of the driving transistor DT is detected.

In this example embodiment, the reference voltage Vr of the first terminal of the driving transistor DT may be obtained by reading a voltage signal of the detection line Sense Line.

Since the detection line Sense Line is grounded through the charging capacitor C, the voltage of the first terminal of the driving transistor DT will gradually increase as the output current of the driving transistor DT charges the charging capacitor C through the second transistor T2.

According to the I-V characteristic of the driving transistor DT, it can be seen that the output current of the driving transistor DT is: $Iout=K\times(Vgs-Vth)^2=K\times(Vg-Vs-Vth)^2=K\times(V1-Vs-Vth)^2$.

Based on this, when the second driving voltage V2 is set, the threshold voltage Vth of the driving transistor DT may be compensated first, that is, let V2=V3+Vth, and then the output current of the driving transistor DT according to the above relationship becomes:

$$Iout=K\times(V3+Vth-Vs-Vth)^2=K\times(V3-Vs)^2;$$

wherein V3 is a difference value between the second driving voltage V2 and the threshold voltage Vth of the driving transistor DT; Vs is the voltage of the first terminal of the driving transistor DT, that is, the reference voltage Vr to be detected, and it is also the charging voltage of the second transistor T2.

In this case, in order to reduce the influence of the voltage Vs (i.e., the reference voltage Vr) of the first terminal of the driving transistor DT on the output current thereof, it may also be required to make V3>>Vs. Specifically, the difference value V3 of the second driving voltage V2 and the threshold voltage Vth of the driving transistor DT should be at least ten times higher than the reference voltage Vr. In specific implementation, the above relationship may be satisfied by providing a large enough second driving voltage V2 to make the difference value V3 between the second driving voltage V2 and the threshold voltage Vth of the driving transistor DT sufficiently large while shortening the charging time of the second transistor T2.

S23, the mobility K of the driving transistor DT is acquired according to the reference voltage Vr.

In the related art, the output current of the driving transistor DT is related to the threshold voltage Vth and the mobility K thereof. However, in the present exemplary embodiment, the threshold voltage Vth of the driving transistor DT has been compensated when the second driving voltage V2 is set, which eliminates the influence of the threshold voltage Vth on the driving transistor DT. In this case, the output current of the driving transistor DT is only related to its mobility K. Based on this, since different mobility K of each driving transistor DT results in different output current, the charging voltage (i.e., the reference voltage Vr) obtained by the charging capacitor C is also different. That is, the charging voltage, i.e., the reference voltage Vr may reflect the difference in the mobility K.

In this way, as long as the reference voltage Vr is obtained, the mobility K of the driving transistor DT may be obtained according to the relationship between the reference voltage Vr and the mobility K of the driving transistor DT. The relationship between the reference voltage Vr and the mobility K of the driving transistor DT may be specifically obtained by analog computation or experimental means, which will not be repeated herein.

Based on the above steps S21-S23, the mobility K of the driving transistor DT may be obtained. During the acquisition of the mobility K of the driving transistor DT, the threshold voltage Vth of the driving transistor DT has been compensated.

In step S3, the OLED pixel is compensated according to the mobility K of the driving transistor DT.

In this example embodiment, the output current of the driving transistor DT obtained in the previous step is: $Iout=K\times(V3+Vth-Vs-Vth)^2=K\times(V3-Vs)^2$.

When $V3>>Vs$, $Iout=K\times V3^2$.

It can be seen that, when the difference value V3 between the second driving voltage V2 and the threshold voltage Vth of the driving transistor DT is fixed, the output current of the driving transistor DT is only related to the mobility K. In order to eliminate the influence of the mobility K of the driving transistor DT on the output current thereof, a compensation voltage Vo may be acquired according to the difference value V3 between the second driving voltage V2 and the threshold voltage Vth of the driving transistor DT and the mobility K of the driving transistor DT. The compensation voltage Vo may equal to a ratio of the difference value V3 between the second driving voltage V2 and the threshold voltage Vth of the driving transistor DT to a square root of the mobility K of the driving transistor DT, i.e., $Vo=(V2-Vth)/\sqrt{K}=V3/\sqrt{K}$, to achieve compensation for the mobility K of the driving transistor DT.

Based on the above steps S1-S3, the compensation for the OLED pixel may be achieved by compensating the threshold voltage Vth and the mobility K of the driving transistor DT, so as to improve the luminance uniformity between the OLED pixels to obtain excellent display image quality.

Figure 3:
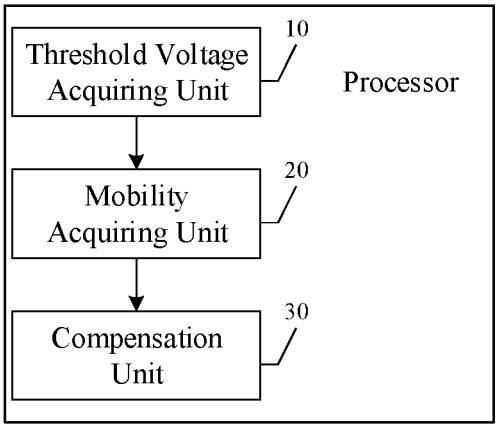
FIG. 3 schematically shows a structural block diagram of a compensation apparatus for an OLED pixel in an exemplary embodiment of the present disclosure.

As shown in FIG. 3, the present exemplary embodiment further provides a compensation apparatus for an OLED pixel, which may include:

a threshold voltage acquiring unit 10, configured to acquire a threshold voltage Vth of a driving transistor DT;

a mobility acquiring unit 20, configured to acquire a mobility K of the driving transistor DT according to the threshold voltage Vth of the driving transistor DT; and a compensation unit 30, configured to compensate the OLED pixel according to the mobility K of the driving transistor DT.

In the embodiment, the threshold voltage Vth of the driving transistor is obtained according to the first driving voltage V1 and the critical voltage Vsc of the first terminal of the driving transistor DT. The mobility K of the driving transistor DT is obtained according to the reference voltage Vr of the first terminal of the driving transistor DT, i.e., the charging voltage of the second driving transistor T2. In one embodiment, the units such as the threshold voltage acquiring unit 10, the mobility acquiring unit 20, the compensation unit 30 and the like may be implemented by circuits that are configured accordingly.

It should be noted that, specific details of each module unit in the OLED pixel compensation apparatus have been described in detail in the corresponding OLED pixel compensation method, and details are not described herein again.

The present example embodiment further provides a display apparatus, including the OLED pixel compensation apparatus described above. In the embodiment, the output current of the driving transistor DT in each pixel unit of the display apparatus tends to be consistent, which may ensure the luminance uniformity of the display apparatus, so as to improve the display image quality. In the present example embodiment, for example, the display apparatus may include any product or component having a display function, such as a cell phone, a tablet, a television, a notebook computer, a digital photo frame, a navigator and the like.

It should be noted that although several modules or units of the device for action execution are mentioned in the detailed description above, this division is not mandatory. In fact, according to the embodiments of the present disclosure, the features and functions of two or more modules or units described above may be embodied in one module or unit. Conversely, the features and functions of one module or unit described above may be further divided into a plurality of modules or units to be embodied.

In addition, although various steps of the methods of the present disclosure are described in the drawings in a particular order, it does not require or imply that the steps must be performed in that particular order, or that all of the illustrated steps must be performed in order to achieve the desired result. Additionally or alternatively, some steps may be omitted, a plurality of steps may be combined into one step, and/or one step may be broken down into a plurality of steps to be performed.

Based on the foregoing description of the embodiments, those skilled in the art may readily understand that the example embodiments described herein may be implemented by software, and may also be implemented by software in combination with necessary hardware. Therefore, the technical solutions according to the embodiments of the present disclosure may be embodied in the form of a software product that can be stored on a non-volatile storage medium (which may be a CD-ROM, a USB flash drive, a removable hard disk, etc.) or a network, which includes instructions to enable a computing device (which may be a personal computer, a server, a mobile terminal, or a network device, etc.) to perform a method in accordance with an embodiment of the present disclosure.

Other embodiments of the present disclosure will readily occur to those skilled in the art upon consideration of the specification and practice of the invention disclosed herein. This application is intended to cover any variation, use, or adaptation of the present disclosure that follows the general principles of the present disclosure and includes common knowledge or conventional technological means in the art which is not disclosed in the present disclosure. It is intended that the specification and embodiments are considered as exemplary only, with the true scope and spirit of the present disclosure being indicated by following claims.

What is claimed is:

1. A compensation method for an OLED pixel, comprising:

acquiring a threshold voltage of a driving transistor;

acquiring a mobility of the driving transistor according to the threshold voltage of the driving transistor; and compensating the OLED pixel according to the mobility of the driving transistor, wherein the acquiring a threshold voltage of a driving transistor comprises:

applying a first driving voltage to a control terminal of the driving transistor to turn on the driving transistor;

detecting a critical voltage of a first terminal of the driving transistor when an output current of the driving transistor changes from non-zero to zero;

acquiring the threshold voltage of the driving transistor according to the first driving voltage and the critical voltage; and setting an initial voltage of the first terminal of the driving transistor to zero while the first driving voltage is applied to the control terminal of the driving transistor.

2. The compensation method according to claim 1, wherein the acquiring a threshold voltage of a driving transistor further comprises:

increasing the voltage of the first terminal of the driving transistor through a charging capacitor before detecting the critical voltage of the first terminal of the driving transistor when the output current of the driving transistor changes from non-zero to zero.

3. The compensation method according to claim 1, wherein the first driving voltage is provided to the control terminal of the driving transistor by a data line through a first transistor, and wherein the first transistor is turned on in response to a first scan signal.

4. A compensation method for an OLED pixel, comprising:

acquiring a threshold voltage of a driving transistor;

acquiring a mobility of the driving transistor according to the threshold voltage of the driving transistor; and compensating the OLED pixel according to the mobility of the driving transistor;

wherein the acquiring a mobility of the driving transistor according to the threshold voltage of the driving transistor comprises:

applying a second driving voltage to a control terminal of the driving transistor to turn on the driving transistor;

detecting a reference voltage of a first terminal of the driving transistor; and acquiring the mobility of the driving transistor according to the reference voltage, wherein a difference value between the second driving voltage and the threshold voltage of the driving transistor is at least ten times higher than the reference voltage.

5. The compensation method according to claim 4, wherein the acquiring a mobility of the driving transistor according to the threshold voltage of the driving transistor further comprises:

setting the voltage of the first terminal of the driving transistor to zero while the second driving voltage is applied to the control terminal of the driving transistor.

6. The compensation method according to claim 4, wherein the acquiring a mobility of the driving transistor according to the threshold voltage of the driving transistor further comprises:

increasing the voltage of the first terminal of the driving transistor through a charging capacitor before detecting the reference voltage of the first terminal of the driving transistor.

7. The compensation method according to claim 4, wherein the reference voltage is provided to the first terminal of the driving transistor by a detection line through a second transistor, and wherein the second transistor is turned on in response to a second scan signal.

8. The compensation method according to claim 4, wherein the compensating the OLED pixel according to the mobility of the driving transistor comprises:

acquiring a compensation voltage according to the difference value between the second driving voltage and the threshold voltage of the driving transistor and the mobility of the driving transistor.

9. The compensation method according to claim 8, wherein the compensation voltage is a ratio of the difference value between the second driving voltage and the threshold voltage of the driving transistor to a square root of the mobility of the driving transistor.

10. A compensation apparatus for an OLED pixel, comprising a processor, wherein the processor is configured to perform the steps of the method according to claim 4.

11. A display apparatus, comprising the pixel compensation apparatus according to claim 10.

12. A compensation method for an OLED pixel, comprising:

acquiring a threshold voltage of a driving transistor;

acquiring a mobility of the driving transistor according to the threshold voltage of the driving transistor; and compensating the OLED pixel according to the mobility of the driving transistor;

wherein a voltage is provided to a control terminal of the driving transistor by a data line through a first transistor, and a voltage is provided to a first terminal of the driving transistor by a detection line through a second transistor, wherein the first transistor is turned on in response to a first scan signal and the second transistor is turned on in response to a second scan signal.

13. A compensation apparatus for an OLED pixel, comprising a processor, wherein the processor is configured to perform the steps of the method according to claim 12.

14. A display apparatus, comprising the pixel compensation apparatus according to claim 13.

* * * * *